US009881335B2

(12) United States Patent
Friedman

(10) Patent No.: US 9,881,335 B2
(45) Date of Patent: Jan. 30, 2018

(54) SYSTEM AND METHOD FOR SELECTING PERSONALITIES TO FACILITATE THE COMPLETION OF AN ONLINE AUCTION

(71) Applicant: Ten-X, LLC, Irvine, CA (US)

(72) Inventor: Robert Friedman, Laguna Hills, CA (US)

(73) Assignee: Ten-X, LLC, Irvine, CA (US)

( * ) Notice: Subject to any disclaimer, the term of this patent is extended or adjusted under 35 U.S.C. 154(b) by 891 days.

(21) Appl. No.: 14/210,231

(22) Filed: Mar. 13, 2014

(65) Prior Publication Data

US 2014/0279150 A1 Sep. 18, 2014

Related U.S. Application Data

(60) Provisional application No. 61/799,280, filed on Mar. 15, 2013.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC .... G06Q 30/00; G06Q 30/08; G06Q 30/0601; G06Q 30/0641; G06Q 30/0633; G06Q 40/04
USPC ..... 705/26.3, 28, 37, 35; 235/375, 383
See application file for complete search history.

(56) References Cited

U.S. PATENT DOCUMENTS 5,845,265 A * 12/1998 Woolston ..... G06Q 20/12 705/37
5,857,174 A 1/1999 Dugan
6,058,379 A 5/2000 Odom et al.
6,085,176 A * 7/2000 Woolston ..... G06Q 20/10 705/16
6,813,612 B1 11/2004 Rabenold et al.
6,947,906 B1 9/2005 Underwood et al.
7,213,000 B2 5/2007 Gutierrez et al.
7,225,151 B1 5/2007 Konia
7,296,033 B1 11/2007 Lynch
7,389,294 B2 * 6/2008 Kotas ..... G06Q 10/087 705/28
7,472,076 B2 12/2008 Garg et al.
7,472,077 B2 * 12/2008 Roseman ..... G06Q 30/02 235/383

(Continued)

FOREIGN PATENT DOCUMENTS

AU 2009100313 A4 5/2009
WO WO 2012/002229 5/2012

OTHER PUBLICATIONS

International Search Report and Written Opinion dated Jun. 25, 2014, Application No. PCT/US2014/021733, 11 Pages.

(Continued)

*Primary Examiner* — Andrew Joseph Rudy
(74) *Attorney, Agent, or Firm* — Mahamedi IP Law LLP

(57) ABSTRACT

A method and system for progressing an auction is provided. Examples include an auction analysis component configured to analyze an auction forum for auctions that are likely to complete without a reserve price being met (i.e., triggered auctions), and a personality selection component configured to select a personality capable of facilitating the progression of a triggered auction.

20 Claims, 4 Drawing Sheets

(56) References Cited

U.S. PATENT DOCUMENTS

| | | | | |
|---|---|---|---|---|
| 7,493,274 | B2 * | 2/2009 | Bezos | G06Q 30/02 235/383 |
| 7,493,280 | B2 * | 2/2009 | Guler | G06Q 30/08 705/35 |
| 7,497,369 | B2 * | 3/2009 | Dalzell | G06Q 30/02 235/375 |
| 7,555,445 | B2 * | 6/2009 | Moya | G06Q 30/08 705/26.3 |
| 7,613,633 | B1 * | 11/2009 | Woolston | G06Q 20/10 705/1.1 |
| 7,617,145 | B1 | 11/2009 | Peterson | |
| 7,653,575 | B2 * | 1/2010 | Lin | G06Q 30/08 705/1.1 |
| 7,752,119 | B2 * | 7/2010 | Ghani | G06Q 30/08 705/37 |
| 7,970,674 | B2 | 6/2011 | Cheng et al. | |
| 7,980,466 | B2 * | 7/2011 | Lee | G06Q 30/02 235/383 |
| 8,103,540 | B2 * | 1/2012 | Gross | G06Q 30/02 705/7.33 |
| 8,108,264 | B1 | 1/2012 | Davis | |
| 8,234,180 | B2 * | 7/2012 | Danzan | G06Q 30/0605 705/26.2 |
| 8,386,330 | B1 | 2/2013 | Kulavade et al. | |
| 8,560,479 | B2 * | 10/2013 | Bosworth | G06F 19/3431 706/47 |
| 8,751,343 | B2 * | 6/2014 | Van Luchene | A63F 13/12 705/35 |
| 8,751,344 | B2 * | 6/2014 | Van Luchene | G06Q 40/02 705/35 |
| 8,781,912 | B2 * | 7/2014 | Solari | G06Q 30/08 705/26.3 |
| 2002/0087389 | A1 | 7/2002 | Sklarz et al. | |
| 2003/0229552 | A1 | 12/2003 | Lebaric et al. | |
| 2004/0049440 | A1 | 3/2004 | Shinoda et al. | |
| 2005/0154657 | A1 | 7/2005 | Kim et al. | |
| 2005/0197950 | A1 | 9/2005 | Moya et al. | |
| 2006/0218070 | A1 | 9/2006 | Lange | |
| 2007/0106596 | A1 | 5/2007 | Bayyapu et al. | |
| 2007/0203823 | A1 | 8/2007 | Whelchel et al. | |
| 2007/0276745 | A1 | 11/2007 | Harinarayan et al. | |
| 2008/0052219 | A1 * | 2/2008 | Sandholm | G06Q 30/08 705/37 |
| 2008/0235125 | A1 | 9/2008 | Danzan | |
| 2008/0262943 | A1 | 10/2008 | Mullendore | |
| 2008/0301064 | A1 | 12/2008 | Burns | |
| 2009/0112726 | A1 | 4/2009 | Miller et al. | |
| 2011/0173086 | A1 | 7/2011 | Berkowitz | |
| 2012/0084169 | A1 | 4/2012 | Adair et al. | |
| 2012/0239582 | A1 | 9/2012 | Solari et al. | |
| 2012/0246024 | A1 | 9/2012 | Thomas et al. | |
| 2013/0103532 | A1 | 4/2013 | Emura | |
| 2013/0218708 | A1 | 8/2013 | Finkelstein et al. | |

OTHER PUBLICATIONS

International Search Report and Written Opinion dated Jul. 15, 2014, Application No. PCT/US2014/026859, 9 Pages.

International Search Report and Written Opinion dated Jun. 3, 2014, Application No. PCT/US2014/019341, 11 Pages.

Anwar et al. "Bidding behavior in competing auctions: Evidence from eBay", European Economic Review, 307-322 (2006).

Extended European Search Report dated Jul. 13, 2016, Application No. EP 14778060.5, 8 pages.

Extended European Search Report dated Jul. 27, 2016, Application No. EP 14769795.7, 8 pages.

European Office Action, Communication Pursuant to Article 94(3) EPC, dated May 2, 2017 Application No. EP 14778060.5, 6 pages.

International Preliminary Report on Patentability dated Sep. 24, 2015, Application No. PCT/US2014/019341, 8 Pages.

International Preliminary Report on Patentability dated Sep. 24, 2015, Application No. PCT/US2014/026859, 7 Pages.

* cited by examiner

SYSTEM AND METHOD FOR SELECTING PERSONALITIES TO FACILITATE THE COMPLETION OF AN ONLINE AUCTION

RELATED APPLICATION

This application claims the benefit of priority to Provisional Application No. 61/799,280 filed on Mar. 15, 2013, entitled SYSTEM AND METHOD FOR SELECTING PERSONALITIES TO FACILITATE THE COMPLETION OF AN ONLINE AUCTION; the aforementioned priority application being hereby incorporated by reference in its entirety.

TECHNICAL FIELD

Examples described herein relate generally to auctions, and more specifically, to a computer-implemented method for selecting personalities to facilitate the completion of an online action.

BACKGROUND

Numerous online auction forums exist that enable consumers and sellers to transact for various kinds of items, such as collectibles, electronics and other goods or services. However, some auctions may never be completed due to various factors including the seller's reserve price not being met at the end of an auction period.

BRIEF DESCRIPTION OF THE DRAWINGS

The disclosure herein is illustrated by way of example, and not by way of limitation, in the figures of the accompanying drawings and in which like reference numerals refer to similar elements, and in which.

DETAILED DESCRIPTION

Figure 1:
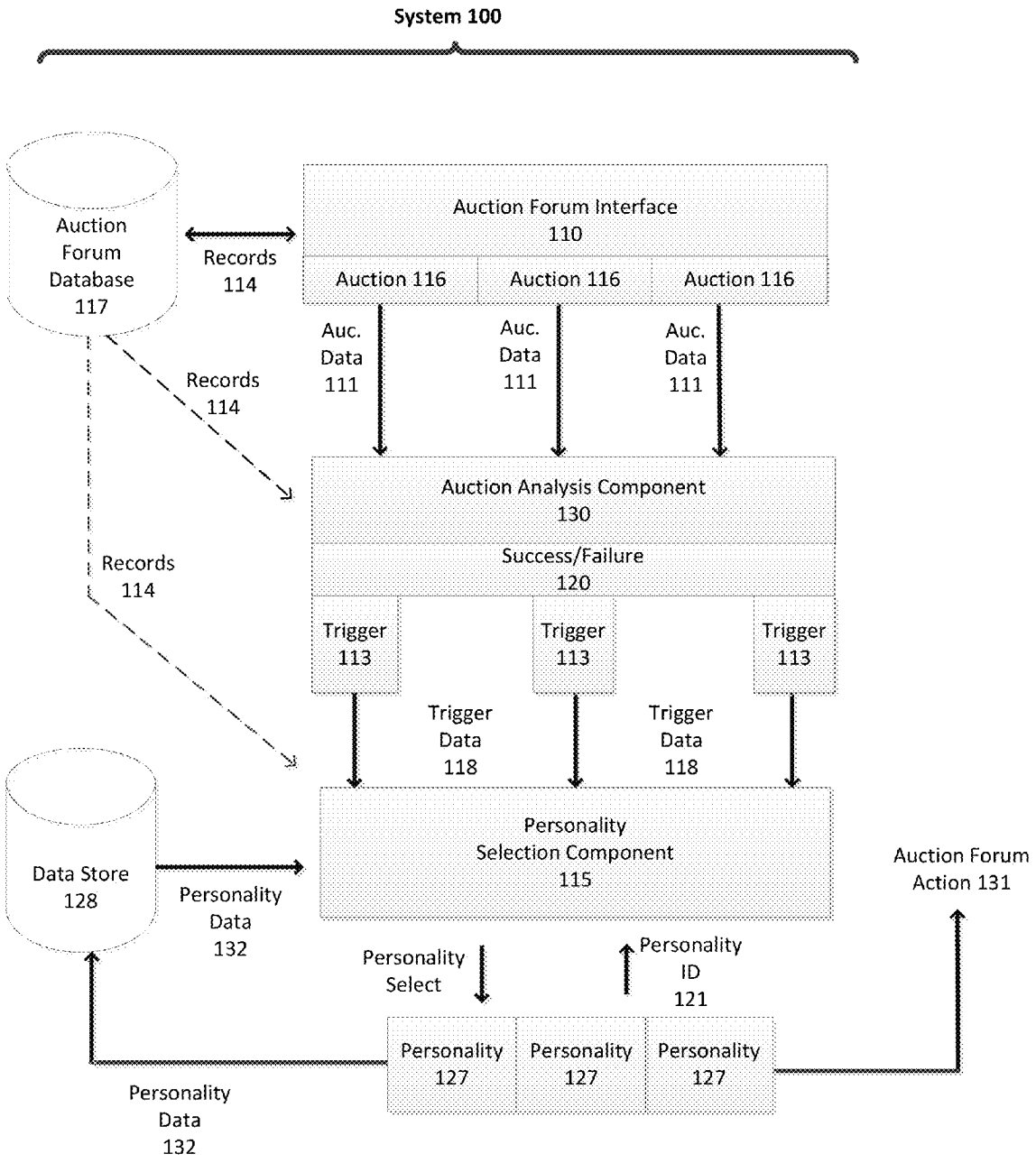
FIG. 1 illustrates a system for implementing an auction analysis component and a personality selection component to facilitate in progressing a triggered auction.

Many auctions fail due to various factors such as the seller's reserve price not being met, normally putting an end to the auction without a sale. For example, prospective purchasers for a particular item may submit several bids that do not amount to the seller's reserve price during the auction period. Normally in this situation, the item is not sold and no transaction takes place between a prospective purchaser and seller. Thus, a failed auction takes place, and consequently, the parties walk away empty-handed.

Examples described herein provide for a system for managing an auction forum including at least one auction for an item with a minimum purchase price (i.e., reserve price). An auction analysis component is included in the system to analyze the auction forum for one or more triggering factors (e.g., when the reserve price is not met) that may indicate an impending failed auction. In response to detecting a triggering factor, a personality selection component is included to select a personality capable of progressing the identified auctions.

Examples described further include an auction forum that includes an interface (e.g., an auction webpage) that displays one or more auctions, or links to one or more auctions, where sellers, items, and prospective buyers may be identified and the corresponding auctions may be analyzed. At any given time, the auction forum may include one or more auctions in which the auction analysis component identifies a triggering factor, in which case those identified auctions may result in the bids not meeting the reserve price.

Systems and methods described based on the foregoing perform steps to facilitate in the completion of an auction. These steps include determining one or more characteristics of the auction, where the auction has a reserve price for an item set by a seller. The steps further include predicting, based on the determined characteristics, whether the auction will complete without the reserve price being met. Furthermore, in response to predicting that the auction will complete without the reserve price being met, the steps include selecting one or more personalities to coach the seller and/or one or more auction participants to complete the auction.

The one or more personalities are selected according to any of the following: (i) a profile of the seller, (ii) one or more profiles of the one or more auction participants, (iii) auction activity history of the seller, or (iv) auction activity history of the one or more auction participants. Furthermore, selecting the one or more personalities can include selecting a human representative associated with the auction forum, or a virtual representative associated with the auction forum. Upon selection, the human or virtual representative can automatically submit one or more bids at or below the reserve price to progress the auction. Further, the disclosed system can be configured to automatically select the one or more personalities to coach the seller and/or one or more auction participants to complete the auction upon a predetermined time period left in the auction.

The one or more characteristics to trigger selection of a personality include any combination of (i) the nature of the item being auctioned, (ii) a price differential between the current highest bid and the reserved price, (iii) a determination that the reserve price is too high based on historical data, (iv) a profile of the seller, (v) a profile of the one or more auction participants, (vi) a location of the item being auctioned, (vii) a valuation of the item being auctioned, (viii) time left in the auction period, or (ix) a progression of the current highest bid.

One or more features described herein may be implemented using programmatic modules or components. A programmatic module or component may include a program, a subroutine, a portion of a program, or a software component or a hardware component capable of performing one or more stated tasks or functions. As used herein, a module or component can exist on a hardware component independently of other modules or components. Alternatively, a module or component can be a shared element or process of other modules, programs or machines.

Furthermore, one or more features described herein may be implemented through the use of instructions that are executable by one or more processors. These instructions may be carried on a computer-readable medium. Machines shown or described with figures below provide examples of processing resources and computer-readable media on which instructions for implementing disclosed variations can be carried and/or executed. In particular, the numerous machines shown with disclosed variations include processor(s) and various forms of memory for holding data and instructions. Examples of computer-readable media include permanent memory storage devices, such as hard drives on personal computers or servers. Other examples of computer storage media include portable storage units, such as CD or DVD units, flash or solid state memory (such as carried on many cell phones and consumer electronic devices) and magnetic memory. Computers, terminals, network enabled devices (e.g., mobile devices such as cell phones) are all examples of machines and devices that utilize processors, memory, and instructions stored on computer-readable media. Additionally, examples may be implemented in the form of computer-programs, or a computer usable carrier medium capable of carrying such a program.

System Architecture

FIG. 1 illustrates a system for facilitating in the completion of triggered auctions in an auction forum in which triggered auctions are detected and coached accordingly. A system 100 such as shown by an example of FIG. 1, can be implemented in connection with an online auction service for any type of commercial item, such as, for example, real property items, (e.g., homes, real-estate notes, commercial property), motor vehicles (e.g., automobiles, motorcycles, boats), consumer electronics, collectibles, clothing, etc.

In an example of FIG. 1, system 100 includes functionality that can be implemented by processes, logical components, and/or modules. In an example of FIG. 1, system 100 includes an auction forum interface 110, where users may participate in one or more auctions 116. Auction data 111 from individual auctions 116 can be analyzed by an auction analysis component 130, which can process and analyze the data 111 for various triggering factors indicating that the auction 116 is likely to fail. Such auction data 111 includes, for example, a reserve price set by a seller using the auction forum 110. Such auction data 111 can also include, for example, buyer data, current bid values, items up for auction, item types, location of the seller, etc. The triggering factors can include the reserve price not being met, or a certain price differential between the highest current bid and the reserve price. Further, a portion of the auction data 111 can originate as records 114 from an auction forum database 117 comprising various data from users and variables of the auction forum. Such records 114 can include, for example, past transaction data including items sold, item types, buyer profile data, seller profile data, individual auction data, compiled auction data, localities, etc. The auction forum database 117 can be coupled to the auction forum itself, or may be made available to aid the auction analysis component 130 in determining whether an auction is likely to succeed or fail. Further, the auction forum database 117 can be made available to a personality selection component 115 to aid in processing trigger data 118 and ultimately selecting a personality 127 to facilitate in progressing or completing a triggered auction (as described in detail below).

The auction analysis component 130 is configured to receive and process auction data 111 from individual auctions 116 in the auction forum. The auction analysis component 130 can also be configured to pull records 114 from the auction forum database 117 to aid in its processing and analysis of auction data 111. The auction analysis component 130 may include a success/fail function 120 that may ultimately determine (i) whether the auction will likely succeed, in which case the auction may be left alone to progress on its own, or (ii) whether the auction will likely fail, in which case a trigger 113 may be executed and trigger data 118 from the triggered auction can be transmitted or otherwise communicated to a personality selection component 115.

The personality selection component 115 is configured to select a personality 127 to facilitate in progressing or completing the triggered auction. In system 100, the personalities 127 can include data structures that define or represent the personality (whether human or programmatic). In an implementation in which at least some of the personalities 127 are human, the data structure provided for personalities 127 can define characteristics of the person, including physical characteristics (sex, age, voice tenor), experience, personality type (e.g., strong seller, soft seller, etc.). Similarly, programmatic personalities can be represented by data structures that define similar characteristics.

The personality selection component 115 may further be configured to select the personality 127 based on criteria such as age matching, gender matching, locality matching, etc. The personality selection component 115 can be coupled to a data store 128, which can be configured to receive personality data 132 from personalities 127. The personalities 127 can ultimately be selected by the personality selection component 115 in order to coach the triggered auction. For example, each personality 127 for selection can be specialized according to the item type that is being auctioned. Furthermore, user profiles of the seller and auction participants can be automatically accessed and analyzed to determine an appropriate personality to aid in coaching the seller and/or one or more of the auction participants. Appropriate or effective personalities can be selected based on characteristics of the seller and/or one or more of the auction participants gleaned from the user data. The personalities can include human "coaches" or programmatic personalities (e.g., computer program that simulates a human being). Still further, the personalities can be implemented in part through graphics and/or media, underlying a generic human operator or programmatic component. In the latter example, the personality can be implemented by, for example, assigning a sex, name and/or vocabulary to a displayed profile representing the personality.

The coaching itself can include, for example, (i) communicating with one or more buyers and/or sellers via the auction forum interface 110, (ii) suggesting actions to the buyer and/or seller, such as suggesting that the seller lower the reserve, (iii) negotiating or suggesting a middle ground to both buyer and seller. As an addition or alternative, the selection of personalities can be used for purpose of programmatically placing bids on behalf of one or more prospective buyers, and/or placing one or more below-reserve bids on behalf of the seller. For example, the selected personality can be presented as a bidder and source of a programmatic bid. Still further, in a variation, the coaching may include communication with one or more sellers and/or prospective buyers via a separate network or interface unassociated with the auction forum interface 110. For example, a human personality may be selected to "close" an auction by calling both seller and buyer.

In some variations, the personality selection component 115 can be included as a portion of the auction analysis component 130. Alternatively, the personality selection component 115 may be contained in a personality selection module, which can be controlled or automatically executed by the trigger 113 communicated from the auction analysis component 130. The personality selection component 115 can include a programmed function to randomly select the personality 127 on and ongoing basis according to demands of the auction analysis component 130. In such a variation, the personality selection component 115 can function as a virtual indicator, informing available personalities 127 that facilitation of a particular triggered auction may be required.

In other variations, the personality selection component 115 is programmatically configured to select the personality 127 based on any number of factors and/or variables comprised in the trigger data 118, the personality data 132, and/or the records 114 from the auction forum database 117 (e.g., transaction history data, failed bids for the same or similar items, the reserve price for the listed item, type of item being auctioned, quality of the item, location of the item, location of the parties, user profile data of the seller and/or one or more of the auction participants, etc.). In such examples, for each triggered auction, the personality 127 can be selected in a manner that progresses or otherwise completes the triggered auction. Alternatively, the personality selection component 130 can select the personality 127 in order to optimize an ultimately bargained transaction, calculated to be the most reasonable for both seller and ultimate buyer.

In similar variations, the personality selection component 115 can be an individual who functions to select the personality 127 in order to meet the desired outcome of parties to a triggered auction. In such a variation, the selected personality 127 can be configured or otherwise advised to carry out functions in order to progress the triggered auction or otherwise bring about a final transaction.

In addition or alternatively, the selected personality 127 includes a personality identification 121, which can provide the personality selection component 115 with information about the respective personality 127, such as one or more characteristics of the personality 127, and/or whether that personality 127 is, for example, an individual, a virtual coach, or a computer program. In alternative implementations, the personality 127 can be an individual associated with the auction forum, a computer program configured to communicate with one or more buyers and/or sellers (e.g., a virtual coach), a computer program configured to indicate a triggered auction (e.g., a virtual indicator), and/or a computer program configured to place automatic bids on behalf of one of more prospective buyers and/or sellers (e.g., a virtual bidder). The personalities 127 can provide personality data 132 to the data store 128 which can, in turn, provide the personality data 132 to the personality selection component 115 in order to aid in the selection process.

Additionally, in some implementations, the selected personality 127 can execute an auction forum action 131 in order to progress or otherwise complete a triggered auction. Such auction forum actions 131 include, for example, placing bids on behalf of the one or more prospective buyers and/or sellers, advising or communicating with the one or more prospective buyers and/or sellers, or simply sending a notification to one or more parties to the triggered auction. Such a notification can include information that the auction is likely to fail. The notification can also include details describing the reasons or factors as to why the auction will likely fail.

Furthermore, the selected personality 127 can function to progress the triggered auction or otherwise facilitate in completing the triggered auction. The selected personality 127 itself can be programmatically configured to coach the parties to the triggered auction according to any number of factors and/or variables (e.g., transaction history data, failed bids for the same or similar items, the reserve price for the listed item, type of item being auctioned, quality of the item, location of the item, location of the parties, etc.). Alternatively, the selected personality 127 may be configured or otherwise advised to automatically enter a new bid on behalf of one or more prospective buyers or the auction forum itself. Additionally or as an alternative, the selected personality 127 may place a bid on behalf of the seller so long as the bid does not exceed the seller's reserve price.

Still further, the selected personality 127 can communicate to one or more auction participants and/or sellers once the personality selection component 115 receives a trigger 113. In such variations, the personality may act as an intermediary or mediator between the seller and one or more of the auction participants. In facilitating a transaction between the seller and a prospective buyer, a bargained transaction may result in which the final transaction price may be between the current highest bid and the reserve price. In doing so, the triggered auction is successfully completed, thereby avoiding an unnecessary failed auction, and thus allowing a transaction to take place between a buyer and the seller.

In other variations, the selected personality 127 can be configured or otherwise advised to communicate solely with the seller of an item in a triggered auction. In such variations, the triggered auction can be identified by the auction analysis component 130 based on any number of triggering factors (e.g., such as the reserve price not being met or being too high based on historical data), which may then execute a trigger 113. The trigger 113 can transmit a signal, or otherwise cause a signal to be transmitted, to personality selection component 115. The signal can include trigger data 118 so as to aid the personality selection component 115 in selecting a personality 127 accordingly. A personality 127 is then selected to facilitate the progression or completion of the triggered auction 116. In doing so, the personality 127 can simply notify the seller of the item in the triggered auction that the reserve price has not, or will not, be met. Alternatively, the personality 127 can advise or make recommendations to the seller based on the auction data 111 and/or records 114, such as transaction data for the same or similar items. In other variations, the selected personality 127 can be configured or otherwise advised to automatically place a bid on behalf of the seller up to the reserve price. The seller can choose to carry on with the triggered auction, allow the auction to fail, or progress the auction in order to complete a transaction with a prospective buyer.

In still other variations, the selected personality 127 is configured or otherwise advised to communicate solely with one or more of the prospective buyers or auction participants in the event of a trigger 113. As shown by an example in FIG. 1, the triggered auction can be recognized by the auction analysis component 130 according to one or more triggering factors, such as an unmet reserve price. Upon identifying the triggered auction, the analysis component 130 may execute a trigger 113 which can send relevant data 118 from the triggered auction to the personality selection component 115. The personality selection component 115 can then select a personality 127 according to the personality data 132, the records 114 from the auction forum database 117, and/or the trigger data 118. In addition or as an alternative, the personality 127 can be selected based on criteria such as age matching, gender matching, locality matching, etc. As an example, a female bidder can place a bid below the reserve price set by the seller. Accordingly, the personality selection component 115 can elect to choose a female personality 127 to coach the bidder during the triggered auction. As another example, the personality component 115 can access records 114 from the auction forum database 117 comprising user profile information of the seller and/or auction participants. Any data gleaned from the user profile information (i.e., gender, economic status, ethnicity, background, age, location, etc.) can be processed to determine a most effective or most beneficial personality 127 to successfully complete the auction. Furthermore, the personality 127 can be selected to facilitate in progressing the triggered auction, coaching the buyers towards a transaction, and/or automatically submitting a bid for one or more prospective buyers.

The prospective buyers may be current bidders participating in the triggered auction, or they may be outside prospective buyers that the selected personality 127 can recognize as interested parties. The selected personality 127 can be configured or otherwise advised to recognize interested parties based on any number of factors or variables (e.g., transaction history data, failed bids for the same or similar items, the reserve price for the listed item, etc.). The factors can be pulled, configured, constructed, or otherwise organized and arranged based on records 114 from the auction user database 117 or the trigger data 118 from the auction analysis component 130. Additionally or alternatively, the factors may be based on user data from outside sources over, for example, the internet or cloud network.

In such examples, the selected personality 127 can inform or otherwise communicate with such prospective buyers to facilitate in progressing or otherwise completing the triggered auction. For example, the personality 127 can issue a notice to one or more other prospective buyers that may be interested in the item being auctioned. Informed interested parties can then participate in the auction to place bids that may meet the reserve price thereby successfully completing the auction.

In similar variations, one or more current bidders in the triggered auction can have preselected maximum bids kept confidential from the seller and other bidders. In such variations, the selected personality 127 can facilitate in progressing or otherwise completing the triggered auction by coaching those bidders to consequently raise their current bids until either the reserve price has been met or exceeded, or the maximum bids of the current bidders are exhausted.

Additionally or as an alternative, the selected personality 127 can be configured or otherwise advised to communicate with only the highest bidder in the event of an executed trigger 113. In such examples, the selected personality 127 can facilitate in progressing or completing the triggered auction by coaching the current highest bidder to meet the reserve price, or otherwise automatically raise the highest bid in order to potentially procure a final transaction.

The auction analysis component 130 and the personality selection component 115 can implement operations for progressing triggered auctions towards completion. As shown by an example of FIG. 1, multiple instances of triggers 113 and personality selections can be implemented at a given time in order to conduct, progress, and/or ultimately complete multiple triggered auctions. The auction analysis component 130 can be coupled to the auction forum and may receive records 114 from the auction forum database 117. The auction analysis component 130 can be programmatically configured to recognize multiple triggered auctions based on a variety of triggering factors for each particular auction 116 (e.g., type of item, reserve price of the item, whether the reserve price has been met, price differentials, number of current bids, number of prospective buyers, etc.). The personality selection component 115 can include functionality to (i) recognize a trigger signal and/or receive trigger data 118 for a triggered auction, (ii) process personality data 132, auction database records 114, and/or trigger data 118, and/or (iii) select a personality 127 to facilitate in progressing or otherwise completing the triggered auction. The personality 127 can be configured or otherwise advised to (i) communicate with the seller and/or prospective buyers including potentially interested parties, and (ii) facilitate in progressing or completing the triggered auction.

A final transaction can be a transaction between a seller and a buyer in which the reserve price has been lowered sufficiently to meet the highest current bid. Alternatively, the final transaction can be a transaction between the seller and the buyer in which the current highest bid, or any current bid, has been raised to meet the reserve price. Likewise, the final transaction can include a final sale price in which both the current highest bid, or any current bid, is raised towards the reserve price and the reserve price is lowered to definitively meet the final sale price. Similarly still, the final transaction may include a final sale price facilitated by the selected personality 127 in which bids are consequently submitted by interested parties, including prospective buyers, and/or where the seller adjusts the reserve price to meet the ultimate final sale price. Thus, according to any successful bargained transaction, the otherwise triggered auction may be progressed or brought to a successful end.

Methodology

Figure 2:
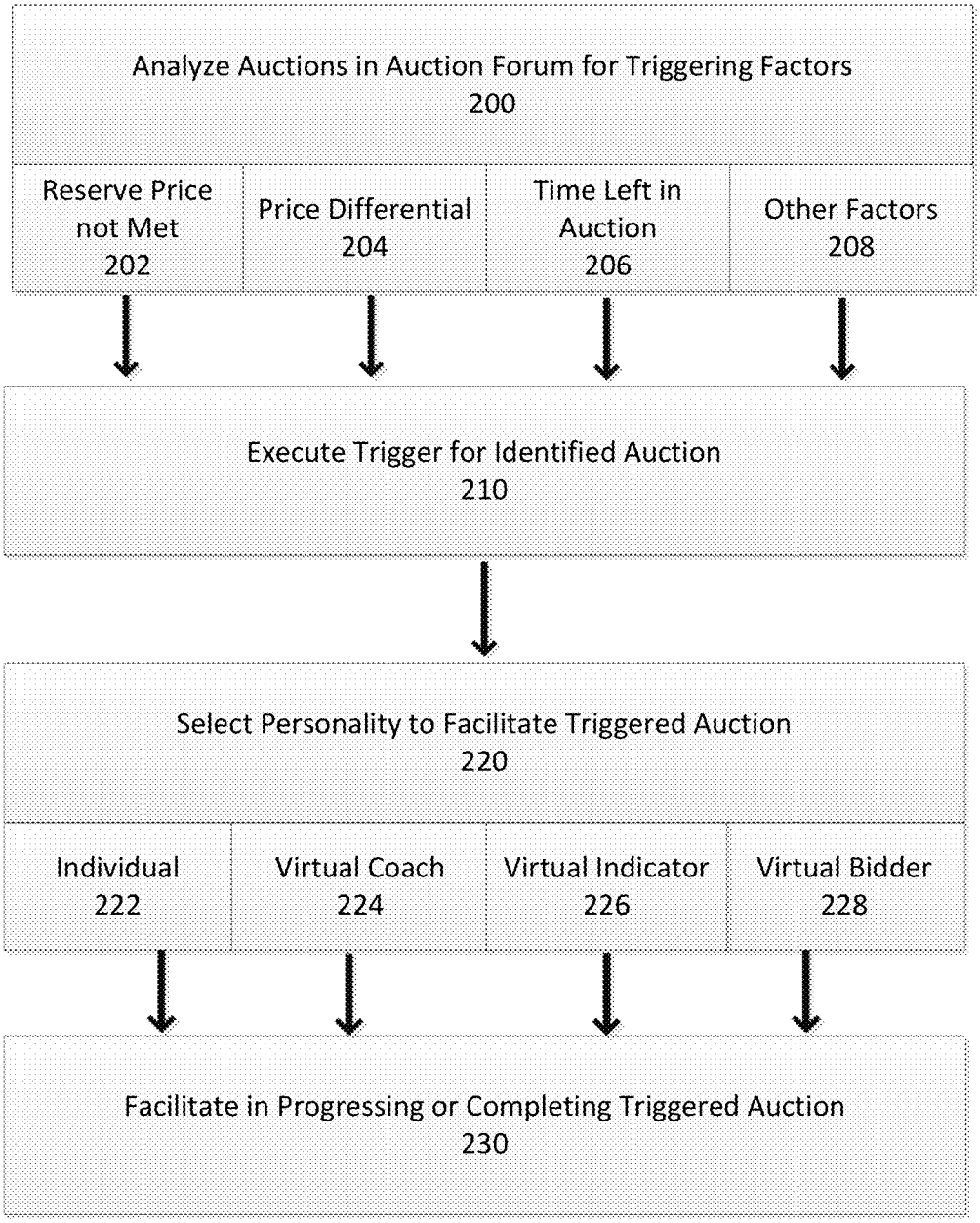
FIG. 2 illustrates an example method of facilitating the progression of a triggered auction.

FIG. 2 illustrates an example method of coaching one or more parties to a triggered auction in order to progress or otherwise complete the auction. Methods such as described by examples of FIG. 2 can be implemented using, for example, a system such as described by an example of FIG. 1. Accordingly, reference may be made to elements of system 100, as shown in an example of FIG. 1, for the purpose of illustrating suitable components or elements for performing a step or sub step being described.

With reference to FIG. 2, the one or more auctions 116 in the auction forum can be analyzed by the auction analysis component 130 for triggering factors (200). The auction analysis component can include a success/fail function, in which certain auctions 116 that meet trigger factor criteria may be flagged or otherwise marked as triggered auctions. One characteristic that can be used as a triggering factor for identifying a triggered auction includes the seller's reserve price not being met for a particular item being auctioned (202). As an addition or alternative, another characteristic that can be used as a triggering factor includes a price differential between the highest bid and the reserve price (204). Further, another example characteristic that can be used as a triggering factor includes a set amount of time left in a respective auction period (206). Still further, other factors or characteristics may be considered as a triggering factor to select a personality (208). The factors can include any combination of the following: the nature of the item being auctioned, a determination that the reserve price is too high based on historical data, a profile of the seller, a profile of the one or more auction participants, a location of the item being auctioned, a valuation of the item being auctioned, or a progression of the current highest bid.

In some examples, information that is descriptive of the auction 116 itself (e.g., as maintained, for example, by an auction forum database 117, or by live data feed of actual auctions taking place, etc.), can be analyzed and treated by the auction analysis component 130 to identify whether the auction 116 is likely to fail. The form of analysis can include text analysis, metadata analysis, or inspection of fields that are indicative of certain characteristics. The characteristics that are used for data analysis can be implemented according to various triggering factors that may be indicative of a particular triggered auction. By way of example, the auction analysis component 130 can analyze auctions 116 taking place within the auction forum using real time auction data, or additionally or alternatively, using records 114 from the auction forum database 117. Thus, for example, auctions for particular items may include various characteristics which may be indicative of whether or not those auctions are likely to fail.

These characteristics can include any one or more of the following: the nature of the item being auctioned, the price differential between the current highest bid and the reserved price, a determination that the reserve price is too high based on historical data, a "momentum" of the auction (e.g., bidding activity and progression of the current highest bid), profile data of the seller and/or one or more of the participants, a location of the item being auctioned (e.g., a real estate location), a valuation of the item being auctioned, time left in the auction period, a comparison between one or more of any of the foregoing, etc.

Based on the triggering factors, once the triggered auction is identified (e.g., according to an unmet reserve price (202), a certain price differential between the highest bid and the reserve price (204), and/or the amount of time left in an auction period (206)), the auction analysis component 130 can execute a trigger 113 for each identified triggered auction (210). The trigger 113 can be transmitted or otherwise communicated to the personality selection component 115, and can include trigger data 118 particular to the triggered auction. The personality selection component 115 can be configured to select a personality 127 in order to facilitate in progressing or completing the triggered auction.

The personality selection component 115 can include a random selection program which selects the personality 127 on an ongoing basis according to demands from the auction analysis component 130. As described above, the personality selection component 115 can also be customized, or programmatically configured to select a personality 127 according to the particular nature of the respective triggered auction.

The executed triggers 113 can transmit or communicate a signal that may include trigger data 118 to the personality selection component 115, which can then function to process records 114 from the auction forum database 117, trigger data 118 from the auction analysis component 130, and/or personality data from the data store 128. The selection component 115 may then select a personality 127 in order to facilitate in progressing or successfully completing a particular triggered auction (220). The personality 127 may be an individual associated with the auction forum (222), a virtual coach, configured to communicate with one or more buyers and/or sellers (224), a virtual indicator configured to indicate a triggered auction (226), and/or a virtual bidder configured to place automatic bids on behalf of one of more prospective buyers and/or sellers (228). The personalities 127 may further provide personality data 132 to a data store 128 which may, in turn, provide the personality data 132 to the personality selection component 115 in order to aid in the selection process.

The selected personality 127 may ultimately facilitate in progressing or completing the triggered auction (230). As described above, the selected personality 127 may be an individual or computer program configured or otherwise advised to perform an auction forum action 131. Such forum actions 131 can include, for example, placing bids on behalf of one or more prospective buyers and/or sellers, advising or communicating with one or more prospective buyers and/or sellers, or simply sending a notification one or more parties to the triggered auction. Such forum actions 131 can further include automatically adjusting a prospective buyer's bid, a seller's reserve price, or a combination of the two. Still further, other forum actions 131 can include informing and/or incorporating potentially interested parties into the triggered auction. Once a final transaction takes place, the triggered auction can be successfully completed and brought to an end.

As shown by an example of FIG. 1, the method as shown by an example of FIG. 2 may be implemented in an auction forum involving multiple triggers 113 and personality selections in order to conduct, progress, and/or ultimately complete multiple triggered auctions at any given time. Thus, facilitation of multiple triggered auctions may take place simultaneously and/or may be staggered according to real time identification of triggered auctions.

Computer System

Figure 3:
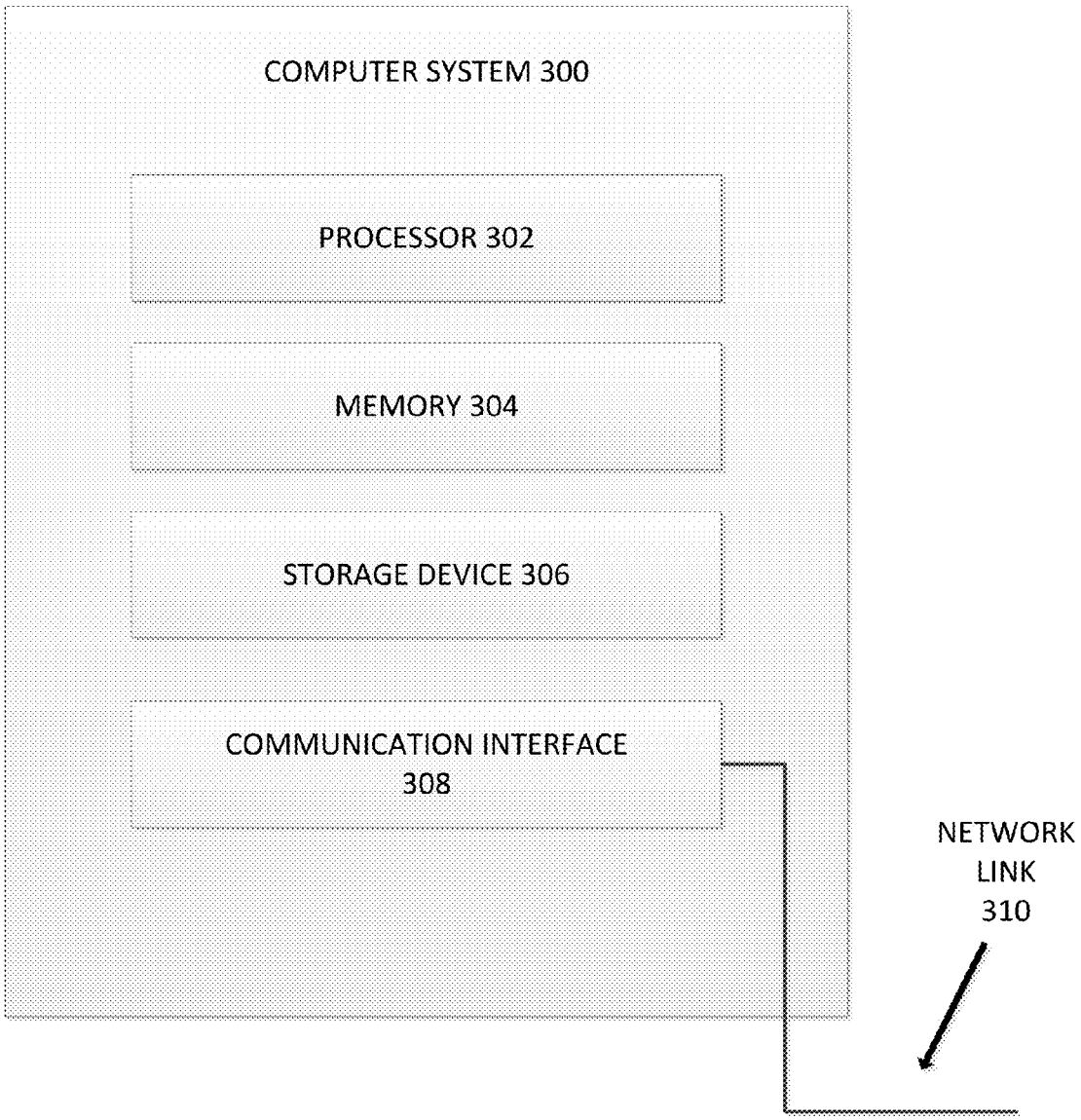
FIG. 3 is a block diagram that illustrates a computer system upon which examples described herein may be implemented.

FIG. 3 is a block diagram that illustrates a computer system upon which variations described herein may be implemented. For example, in the context of FIG. 1, system 100 may be implemented using one or more servers such as described by FIG. 3.

Computer system 300 includes processor 302, memory 304 (including non-transitory memory), storage device 306, and communication interface 308. Computer system 300 includes at least one processor 302 for processing information. Computer system 300 also includes the main memory 304, such as a random access memory (RAM) or other dynamic storage device, for storing information and instructions to be executed by processor 302. Main memory 304 also may be used for storing temporary variables or other intermediate information during execution of instructions to be executed by processor 302. Computer system 300 may also include a read only memory (ROM) or other static storage device for storing static information and instructions for processor 302. The storage device 306, such as a magnetic disk or optical disk, is provided for storing information and instructions. The communication interface 308 may enable the computer system 300 to communicate with one or more networks through use of the network link 310 (wireless or wireline). The communication interface 308 may communicate with one or more auction analysis components 130, personality selection components 115, data stores 128, auction forum databases 117, auction forum interfaces 110, and/or personalities 127 by way of, for example, Ethernet link, the Internet, or other cloud network.

Examples described herein are related to the use of computer system 300 for implementing the techniques described herein. According to one variation, those techniques are performed by computer system 300 in response to processor 302 executing one or more sequences of one or more instructions contained in main memory 304. Such instructions may be read into main memory 304 from another machine-readable medium, such as storage device 306. Execution of the sequences of instructions contained in main memory 304 causes processor 302 to perform the process steps described herein. Alternatively, hard-wired circuitry can be used in place of or in combination with software instructions to implement examples described herein. Thus, examples described are not limited to any specific combination of hardware circuitry and software.

Figure 4:
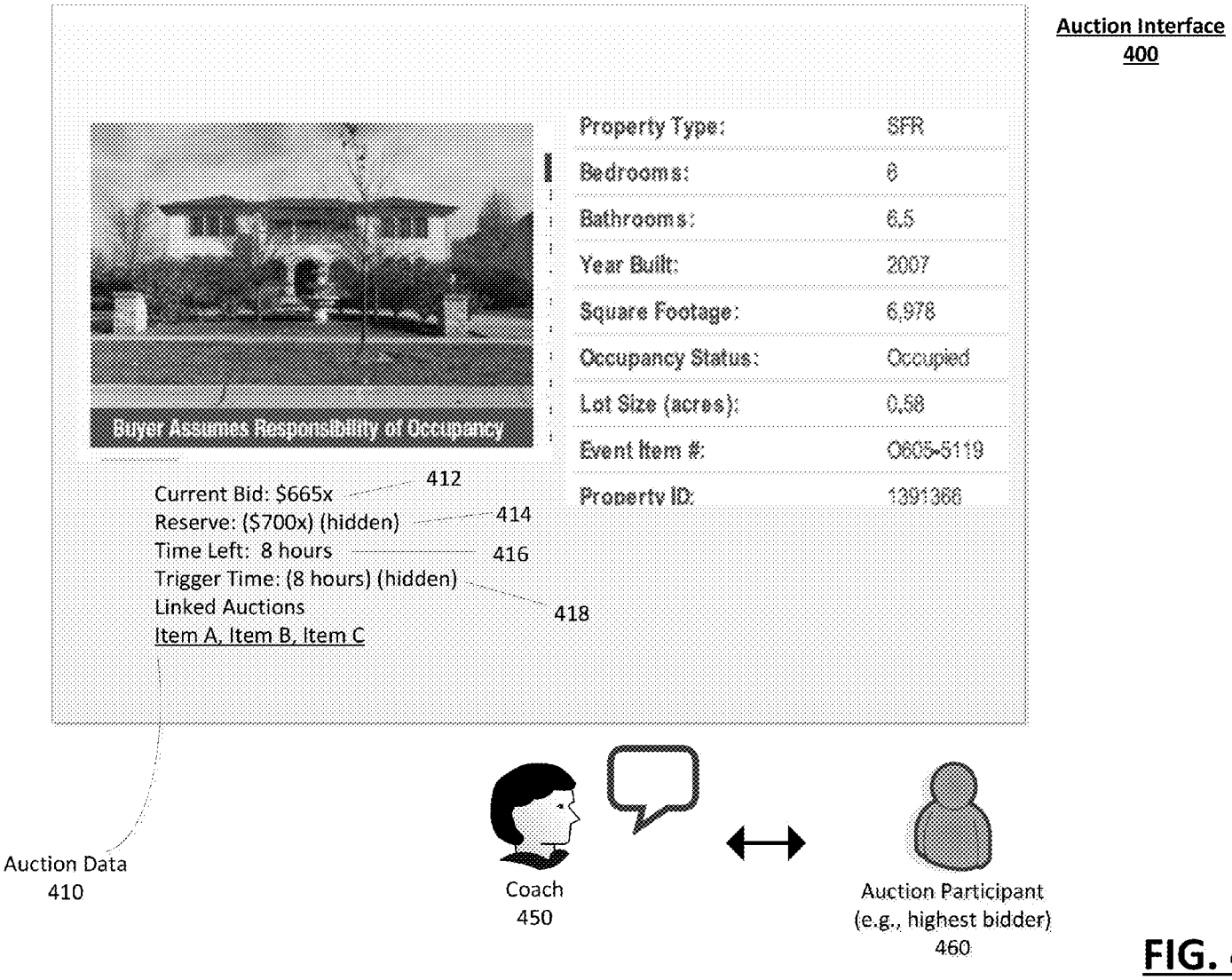
FIG. 4 is an example screenshot of an auction in which a personality has been selected to progress the auction.

FIG. 4 is an example screenshot of an auction in which a personality has been selected to progress the auction according to implementations described with respect to FIGS. 1-3. Referring to FIG. 4, an example of an auction interface 400 is provided showing details of a live auction in progress, in this case, for an item of real estate. The auction period can be set at any time period and tolled during the auction. As discussed above, any number of characteristics may be identified in order to trigger a selection of a personality (e.g., a virtual coach 450) in order to progress the auction to completion. In variations, a human coach can be implemented in place of the virtual coach 450. Furthermore, any number of auction participants 460 can interact with the auction via the auction forum to submit bids, queries, and the like.

Various auction data 410 may be presented on or hidden from the auction interface 400. In the example shown, the auction data include a listed current bid 412, a hidden reserve price 414, a "time left" feature 416 indicated the remaining time in the auction, and a hidden trigger time 418 indicating a time period in which a personality is automatically selected. Various other data may be included such as profile information for the seller and/or the auction participants. As discussed above, any number of factors may trigger the selection of the virtual coach 450. In the example provided, the current highest bid 412 is listed as $665x, which is below the reserve price 414 of $700x. The auction analysis component 130 may make a determination that such a price differential is likely to result in a failed auction and thus trigger the selection of the virtual coach 450. Additionally or as an alternative, the auction analysis component may make the same determination based on a progression of the current bid 412, in which a "momentum" of the current bid 412 will most likely result in a failed auction by the end of the auction period. However, in the example shown in FIG. 4, the selection of the virtual coach 450 has been triggered by the time left feature 416 indicating that there is eight hours remaining in the auction period—which coincides with the trigger time 418 for automatic selection (also eight hours). Eight hours had been chosen as an example trigger time, which can be any value, including one hour, six hours, twelve hours, one day, three days, a week, or even longer.

The virtual coach 450 can be selected based on any number of factor discussed above, and can also be selected to interact with an auction participant 460 (e.g., the current highest bidder), or the seller. In variations where the virtual coach 450 is selected to interact with the seller, the virtual coach may be configured to suggest a reduction in the reserve price 414. In the example shown, the virtual coach 450 has been selected to interact with an auction participant 460 who is the current highest bidder. The virtual coach 450 can indicate the reserve price 414 or make a suggestion that the auction participant's 460 current bid 412 is close to the reserve price 414. Additionally or as an alternative, the virtual coach 450 can connect with both the seller and the current highest bidder 460 in order to achieve a bargained exchange to successfully complete the auction.

Although illustrative examples have been described in detail herein with reference to the accompanying drawings, variations to specific examples and details are encompassed by this disclosure. It is intended that the scope of features described herein be defined by claims and their equivalents. Furthermore, it is contemplated that a particular feature described, either individually or as part of a variation, can be combined with other individually described features, or parts of other variations. Thus, absence of describing combinations should not preclude the inventor(s) from claiming rights to such combinations.

What is claimed is:

1. A computer-implemented method for completing a live auction in an auction forum, the method performed by a network system and comprising:

providing, by the network system, a bidder interface for display on a computing device operated by an auction participant of the auction forum, the computing device being remote to the network system and communicatively coupled to the network system via one or more networks;

determining one or more characteristics of the auction, the auction having a reserve price for an item set by a seller which has not been met by a current highest bid;

determining, based on the one or more characteristics, a predictive indicator indicating whether the auction will complete without the reserve price being met;

based on the predictive indicator indicating that the auction will complete without the reserve price being met, selecting one or more virtual personalities for presentation on the bidder interface, wherein the one or more virtual personalities are selected based, in part, on a user profile maintained for the user of the auction forum; and in response to selecting the one or more personalities, automatically causing the one or more virtual personalities to be presented within the bidder interface displayed on the computing device.

2. The computer-implemented method of claim 1, wherein the one or more virtual personalities are selected according to one or more of (i) a profile of the seller, (ii) one or more profiles of the auction participant, (iii) auction activity history of the seller, or (iv) auction activity history of the auction participant.

3. The computer-implemented method of claim 2, wherein selecting the one or more virtual personalities includes selecting a human representative associated with the auction forum.

4. The computer-implemented method of claim 2, wherein selecting the one or more virtual personalities includes selecting a virtual representative associated with the auction forum.

5. The computer-implemented method of claim 4, wherein upon selection, the virtual representative is to automatically submit one or more bids at or below the reserve price.

6. The computer-implemented method of claim 1, wherein the one or more characteristics include one or more of (i) the nature of the item being auctioned, (ii) a price differential between the current highest bid and the reserve price, (iii) a determination that the reserve price is too high based on historical data, (iv) a profile of the seller, (v) a profile of the auction participant, (vi) a location of the item being auctioned, (vii) a valuation of the item being auctioned, (viii) time left in the auction period, or (ix) a progression of the current highest bid.

7. The computer-implemented method of claim 1, wherein the network system automatically selects the one or more virtual personalities to coach the seller and/or the auction participant to complete the auction upon a predetermined time period left in the auction.

8. A network system for completing one or more live auctions on an auction forum comprising:

one or more processors; and a memory resource storing instructions for completing an auction in progress that, when executed by the one or more processors, cause the network system to:

provide a bidder interface for display on a computing device operated by an auction participant of the auction forum, the computing device being remote to the network system and communicatively coupled to the network system via one or more networks;

determine one or more characteristics of the auction, the auction having a reserve price for an item set by a seller which has not been met by a current highest bid;

determine, based on the one or more characteristics, a predictive indicator indicating whether the auction will complete without the reserve price being met;

based on the predictive indicator indicating that the auction will complete without the reserve price being met, select one or more virtual personalities for presentation within the bidder interface, wherein the one or more virtual personalities are selected based, in part, on a user profile maintained for the user of the auction forum; and in response to selecting the one or more personalities, automatically cause the one or more virtual personalities to be presented within the bidder interface displayed on the computing device.

9. The system of claim 8, wherein the one or more virtual personalities are selected according to one or more of (i) a profile of the seller, (ii) one or more profiles of the auction participant, (iii) auction activity history of the seller, or (iv) auction activity history of the auction participant.

10. The system of claim 9, wherein selecting the one or more virtual personalities includes selecting a human representative associated with the auction forum.

11. The system of claim 9, wherein selecting the one or more virtual personalities includes selecting a virtual representative associated with the auction forum.

12. The system of claim 11, wherein upon selection, the virtual representative is to automatically submit one or more bids at or below the reserve price.

13. The system of claim 8, wherein the one or more characteristics include one or more of (i) the nature of the item being auctioned, (ii) a price differential between the current highest bid and the reserve price, (iii) a determination that the reserve price is too high based on historical data, (iv) a profile of the seller, (v) a profile of the auction participant, (vi) a location of the item being auctioned, (vii) a valuation of the item being auctioned, (viii) time left in the auction period, or (ix) a progression of the current highest bid.

14. The system of claim 8, wherein the executed instructions further cause the network system to automatically select the one or more personalities to coach the seller and/or the auction participants to complete the auction upon a predetermined time period left in the auction.

15. A non-transitory computer-readable medium storing instructions for completing live auctions on an auction forum that, when executed by one or more processors of a network system, causes the network system to:

provide a bidder interface for display on a computing device operated by an auction participant of the auction forum, the computing device being remote to the network system and communicatively coupled to the network system via one or more networks;

determine one or more characteristics of the auction, the auction having a reserve price for an item set by a seller which has not been met by a current highest bid;

determine, based on the one or more characteristics, a predictive indicator indicating whether the auction will complete without the reserve price being met;

based on the predictive indicator indicating that the auction will complete without the reserve price being met, select one or more virtual personalities for presentation within the bidder interface, wherein the one or more virtual personalities are selected based, in part, on a user profile maintained for the user of the auction forum; and in response to selecting the one or more personalities, automatically cause the one or more virtual personalities to be presented within the bidder interface displayed on the computing device.

16. The non-transitory computer-readable medium of claim 15, wherein the one or more virtual personalities are selected according to one or more of (i) a profile of the seller, (ii) one or more profiles of the auction participant, (iii) auction activity history of the seller, or (iv) auction activity history of the auction participant.

17. The non-transitory computer-readable medium of claim 16, wherein selecting the one or more virtual personalities includes selecting a virtual representative associated with the auction forum.

18. The non-transitory computer-readable medium of claim 17, wherein upon selection, the virtual representative is to automatically submit one or more bids at or below the reserve price.

19. The non-transitory computer-readable medium of claim 15, wherein the one or more characteristics include one or more of (i) the nature of the item being auctioned, (ii) a price differential between the current highest bid and the reserved price, (iii) a determination that the reserve price is too high based on historical data, (iv) a profile of the seller, (v) a profile of the auction participant, (vi) a location of the item being auctioned, (vii) a valuation of the item being auctioned, (viii) time left in the auction period, or (ix) a progression of the current highest bid.

20. The non-transitory computer-readable medium of claim 15, wherein the instructions, when executed, further cause the network system to automatically select the one or more virtual personalities to coach the seller and/or the auction participant to complete the auction upon a predetermined time period left in the auction.

* * * * *